US008936245B2

(12) United States Patent
Hopson

(10) Patent No.: US 8,936,245 B2
(45) Date of Patent: Jan. 20, 2015

(54) INTERACTIVE EDUCATIONAL TOY

(71) Applicant: Benjamin D Hopson, Brooklyn, NY (US)

(72) Inventor: Benjamin D Hopson, Brooklyn, NY (US)

( * ) Notice: Subject to any disclaimer, the term of this patent is extended or adjusted under 35 U.S.C. 154(b) by 0 days.

(21) Appl. No.: 14/030,435

(22) Filed: Sep. 18, 2013

(65) Prior Publication Data

US 2014/0175743 A1 Jun. 26, 2014

Related U.S. Application Data

(60) Provisional application No. 61/745,962, filed on Dec. 26, 2012.

(51) Int. Cl.
*A63F 9/08* (2006.01)
*A63H 33/00* (2006.01)

(52) U.S. Cl.
CPC ..... *A63F 9/088* (2013.01)
USPC ..... 273/153 R; 273/153 S; 446/102; 446/115

(58) Field of Classification Search
USPC ..... 273/153 S, 156, 153 R; 446/102, 85, 92, 446/104, 124, 115
See application file for complete search history.

(56) References Cited

U.S. PATENT DOCUMENTS

| | | | | | |
|---|---|---|---|---|---|
| 207,346 | A * | 8/1878 | Clow | 446/114 |
| 1,541,004 | A * | 6/1925 | Taylor | 446/113 |
| 1,853,436 | A * | 4/1932 | Krause | 273/155 |
| 2,206,149 | A * | 7/1940 | Balinkin | 434/277 |
| 2,970,388 | A * | 2/1961 | Yonkers | 446/102 |
| 3,216,558 | A * | 11/1965 | Marsh | 273/153 S |
| 3,458,949 | A * | 8/1969 | Young | 446/124 |
| 3,496,670 | A | 2/1970 | Sloop et al. | |
| 3,596,396 | A | 8/1971 | Thomson | |
| 3,695,617 | A * | 10/1972 | Mogilner et al. | 273/156 |
| 3,872,975 | A | 3/1975 | Silver | |
| 3,977,683 | A * | 8/1976 | Tomura | 273/155 |
| 4,210,333 | A | 7/1980 | Shanin | |
| 4,781,380 | A | 11/1988 | Irwin | |
| 5,330,186 | A * | 7/1994 | Jones | 273/153 S |
| 5,344,148 | A | 9/1994 | Asch | |
| 5,419,558 | A * | 5/1995 | Jones | 273/153 S |
| 6,190,231 | B1 * | 2/2001 | Hoberman | 446/487 |
| 6,273,583 | B1 * | 8/2001 | Trisler | 362/121 |
| 6,626,727 | B2 * | 9/2003 | Balanchi | 446/85 |
| 7,118,442 | B2 * | 10/2006 | Laliberte et al. | 446/85 |
| 8,387,984 | B2 * | 3/2013 | Artsiely | 273/153 S |
| 2009/0203288 | A1 * | 8/2009 | Aggar et al. | 446/120 |

* cited by examiner

*Primary Examiner* — Steven Wong
(74) *Attorney, Agent, or Firm* — Welsh Flaxman & Gitler LLC

(57) ABSTRACT

An interactive educational toy, having six faces in a manner permitting multi-planar movement; each of the six jointed faces is comprised of plurality of bars pivotally connected in a pantographic configuration; the six faces each include sides, and the sides of adjacent faces are hinged together to form a cube that can shift into variously proportioned parallelepipeds.

12 Claims, 6 Drawing Sheets

INTERACTIVE EDUCATIONAL TOY

CROSS REFERENCE TO RELATED APPLICATION

This application claims the benefit of U.S. Provisional Patent Application Ser. No. 61/745,962, entitled "INTERACTIVE EDUCATIONAL TOY", filed Dec. 26, 2012.

BACKGROUND OF THE INVENT ION

1. Field of the Invention

The invention relates to an educational toy. In particular, the invention relates to an interactive educational toy allowing for transformation of the toy into a parallelogram of various shapes.

2. Description of the Related Art

Amusement devices in the shape of three dimensional geometric solids, in the form of cubes, rectanguloids, pyramids, orbs or more sophisticated shapes, have provided challenge and entertainment for many years. These puzzle devices range from those consisting of a few pieces which can be easily assembled to those which include several pieces having intricate interlocking shapes requiring assembly in a precise order.

While the puzzles known in the prior art provide many hours of entertainment some do suffer from major drawbacks. When in their disassembled condition, the parts can be lost or misplaced, thereby making it impossible to complete the puzzle. Often, when partially assembled, some prior art puzzles require a high degree of manual dexterity to hold the pieces in their proper spatial orientation until other pieces locking the subgroup together are brought into position.

SUMMARY OF THE INVENTION

It is, therefore, an object of the present invention to provide an interactive educational toy, comprising: six faces in a manner permitting multi-planar movement; each of the six jointed faces is comprised of plurality of bars pivotally connected in a pantographic configuration; the six faces each include sides, and the sides of adjacent faces are hinged together to form a cube that can shift into variously proportioned parallelepipeds.

It is a further object of the present invention to provide an amusement device and/or geometric puzzle which is a fascinating source of pleasure, curiosity, attention and entertainment.

It is a further object of the present invention to provide an amusement device in the form of a challenging three-dimensional puzzle.

Another object of the present invention is to provide an amusement device which is appealing to the tactile and visual senses.

Other objects and advantages of the present invention will become apparent from the following detailed description when viewed in conjunction with the accompanying drawings, which set forth certain embodiments of the invention.

BRIEF DESCRIPTION OF THE DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views. The invention may take physical form in certain parts and arrangement of parts. For a more complete understanding of the present invention, reference is now made to the following drawings, in which.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

In accordance with the present invention, and with reference to FIGS. 1 to 9, an interactive educational toy 10 is disclosed. The interactive educational toy 10 is composed of a plurality of plastic bars, for example, and in accordance with a preferred embodiment of the present invention, 48 plastic bars joined together using snap fits and hinges. In fact, the present interactive educational toy 10 resembles a cage-like cube with six faces 100, 200, 300, 400, 500, 600 joined together in a manner permitting multi-planar movement. Each of the six jointed faces 100, 200, 300, 400, 500, 600 is comprised of 8 bars connected by pivots in a pantographic/"scissor joint" configuration. This allows the bars to move in such a way that each of the six faces can transform from a square into parallelepiped of various shapes.

The six faces 100, 200, 300, 400, 500, 600 are hinged together along their sides to form a cube that can shift into variously proportioned parallelepipeds, which are three-dimensional prismatic solids. The present interactive educational toy 10 is primarily intended as an entertaining toy, but due to its clear demonstration of various geometric, perspectival, and mechanical principles, it could also prove useful as an educational aid.

Referring now to the various figures, the first face 100 includes eight bars 102, 104, 106, 108, 110, 112, 114, 116 connected together in a manner defining a lattice structure. The eight bars 102, 104, 106, 108, 110, 112, 114, 116 are of the same size and shape. The bars 102, 104, 106, 108, 110, 112, 114, 116 are preferably composed of injection molded plastic. Although eight bars are described herein in accordance with a preferred embodiment, it is appreciated the concepts underlying the present invention may be achieved with more or less bars so long as the bars are arranged in a lattice structure consistent with the principles of the present invention.

Figure 1:
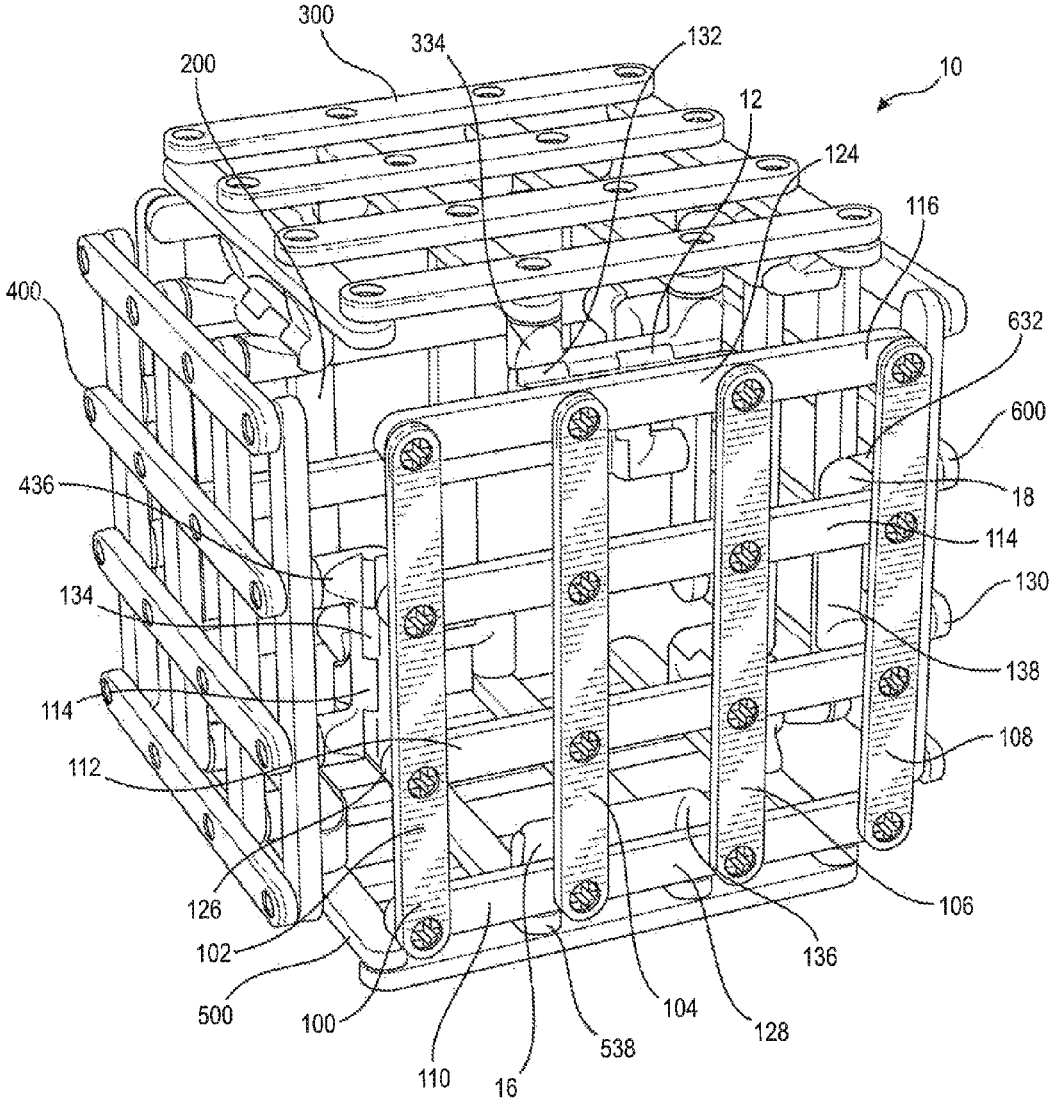
FIG. 1 is a perspective view of the present interactive education toy.
Figure 2:
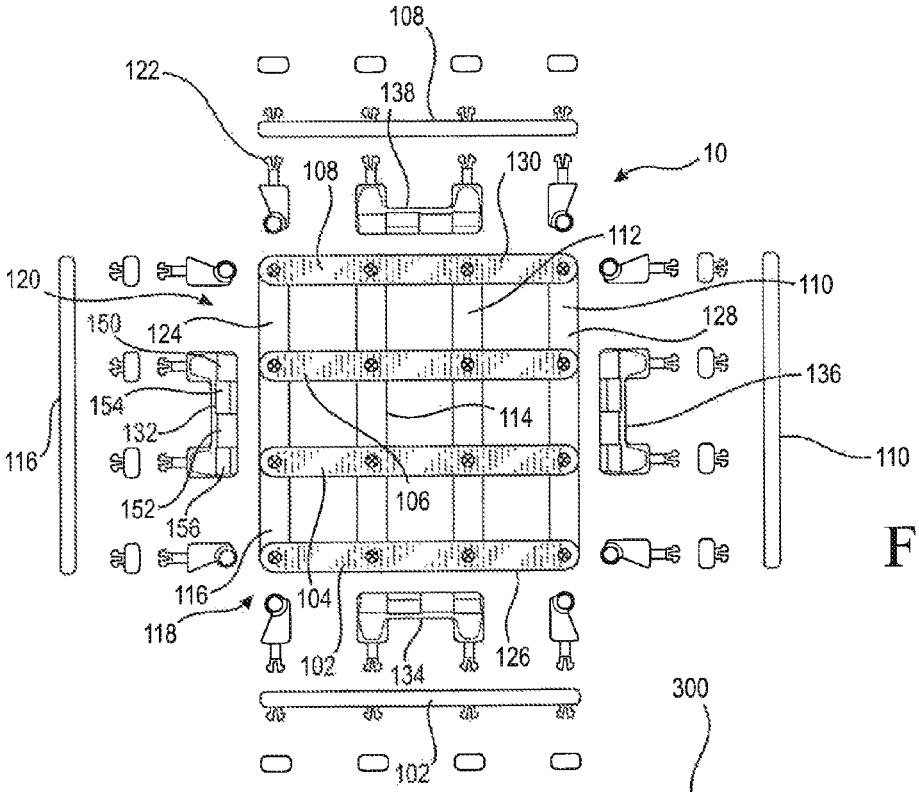
FIG. 2 is an exploded view of the first face of the interactive educational toy.
Figure 3:
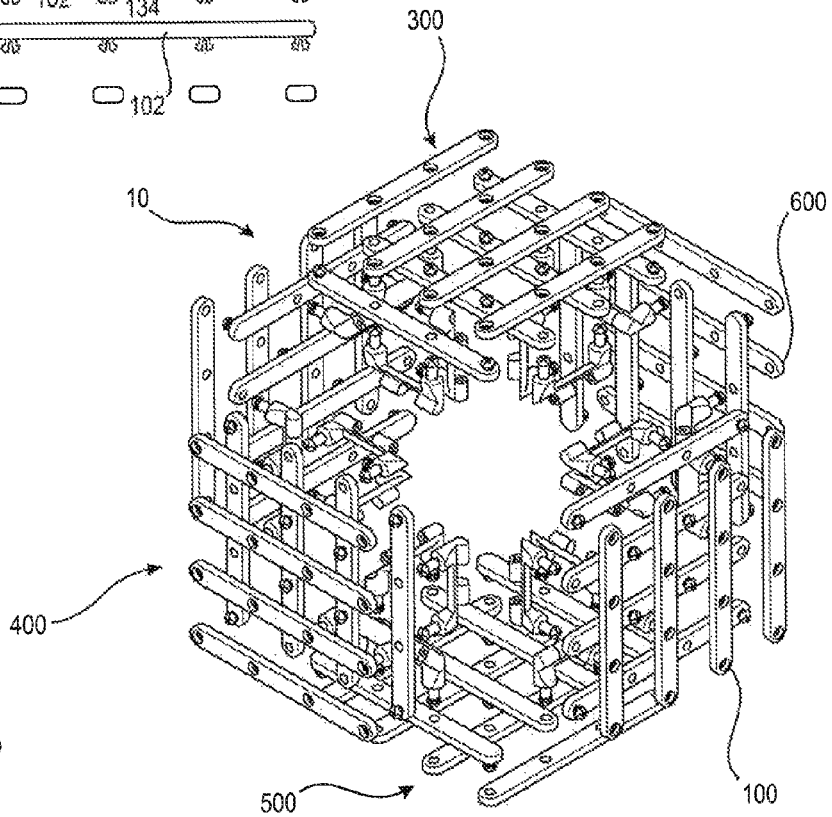
FIG. 3 is an exploded view of the interactive educational toy.
Figure 4:
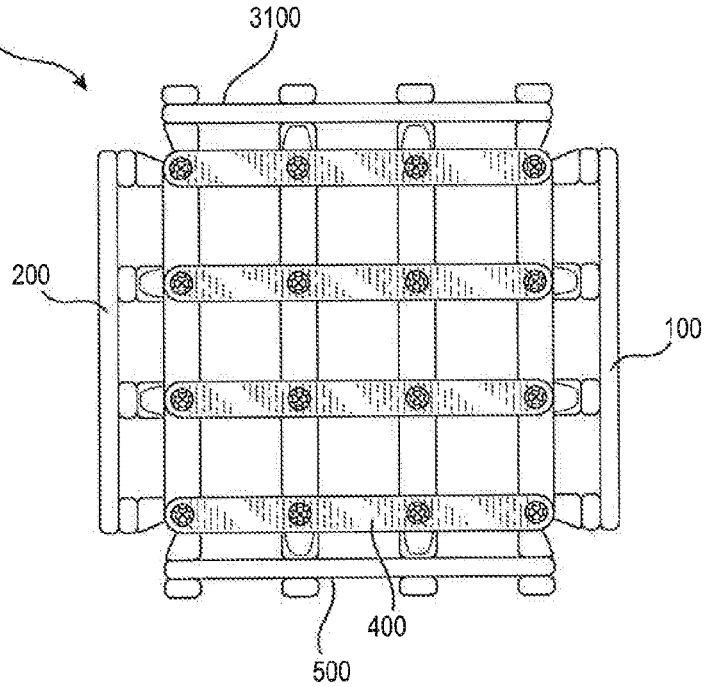
FIG. 4 is a side view of the interactive educational toy.
Figure 5:
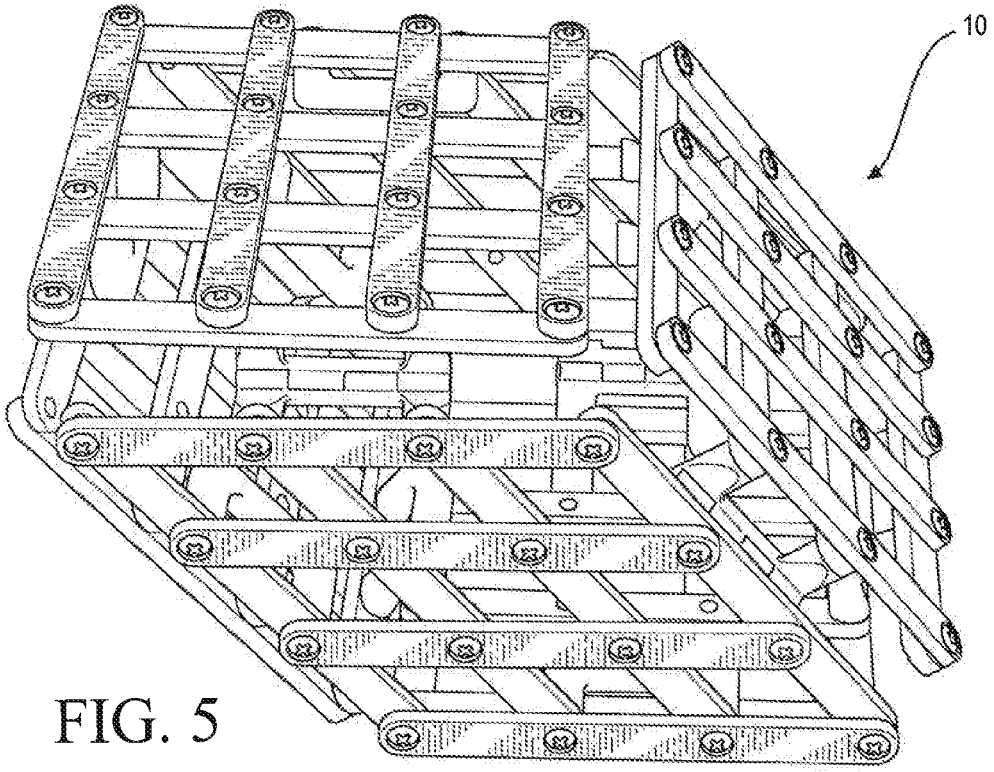
FIGS. 5 to 9 show the interactive educational toy in various forms. It should appreciated the prototype used for these figures was manufactured with screws holding the various parts together, while a preferred embodiment as disclosed in the other Figures employs all plastic snap fit coupling members.
Figure 6:
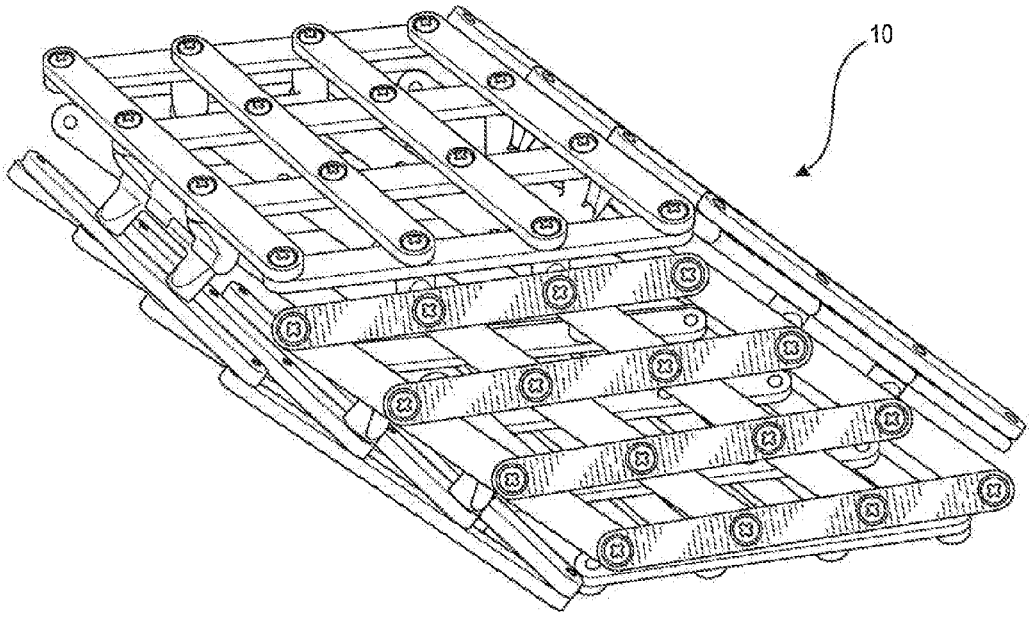
Figure 7:
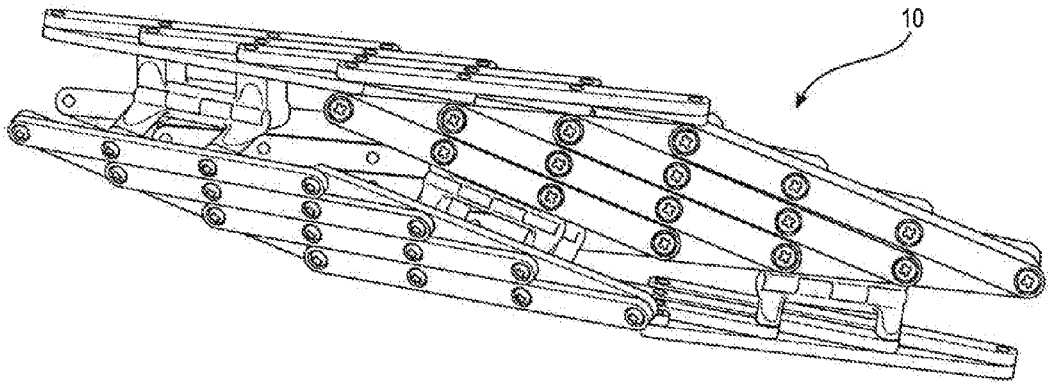
Figure 8:
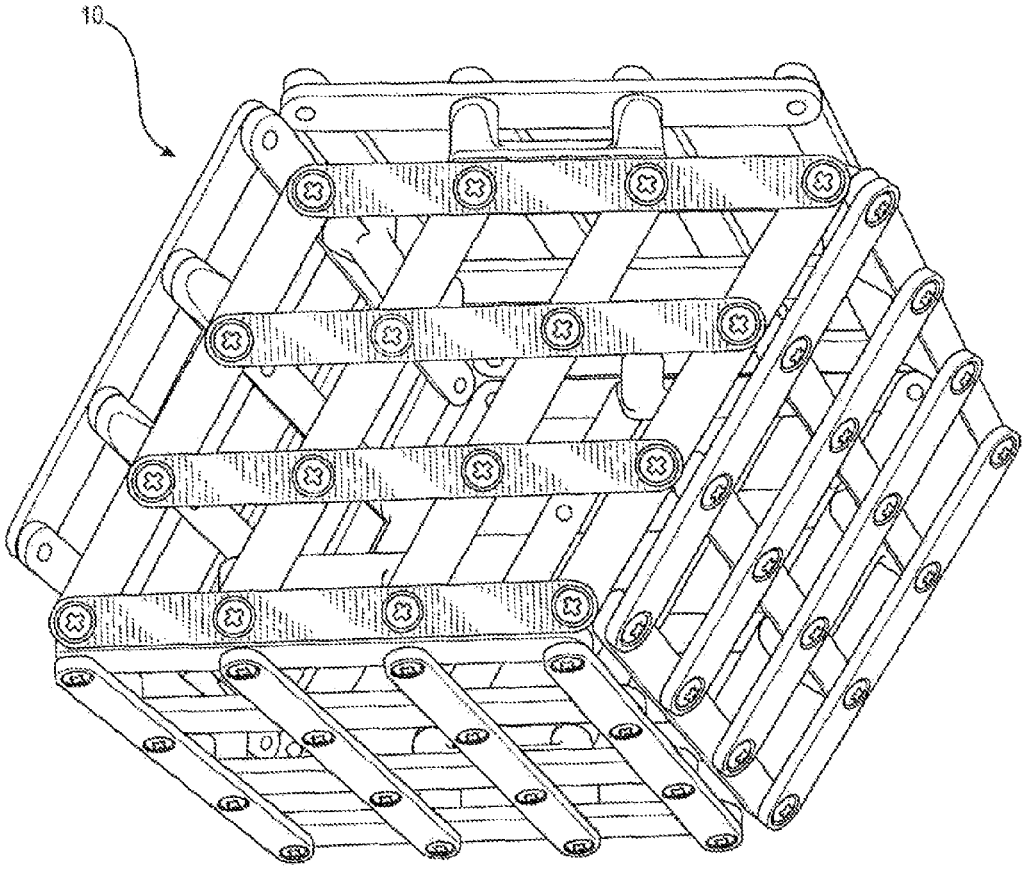
Figure 9:
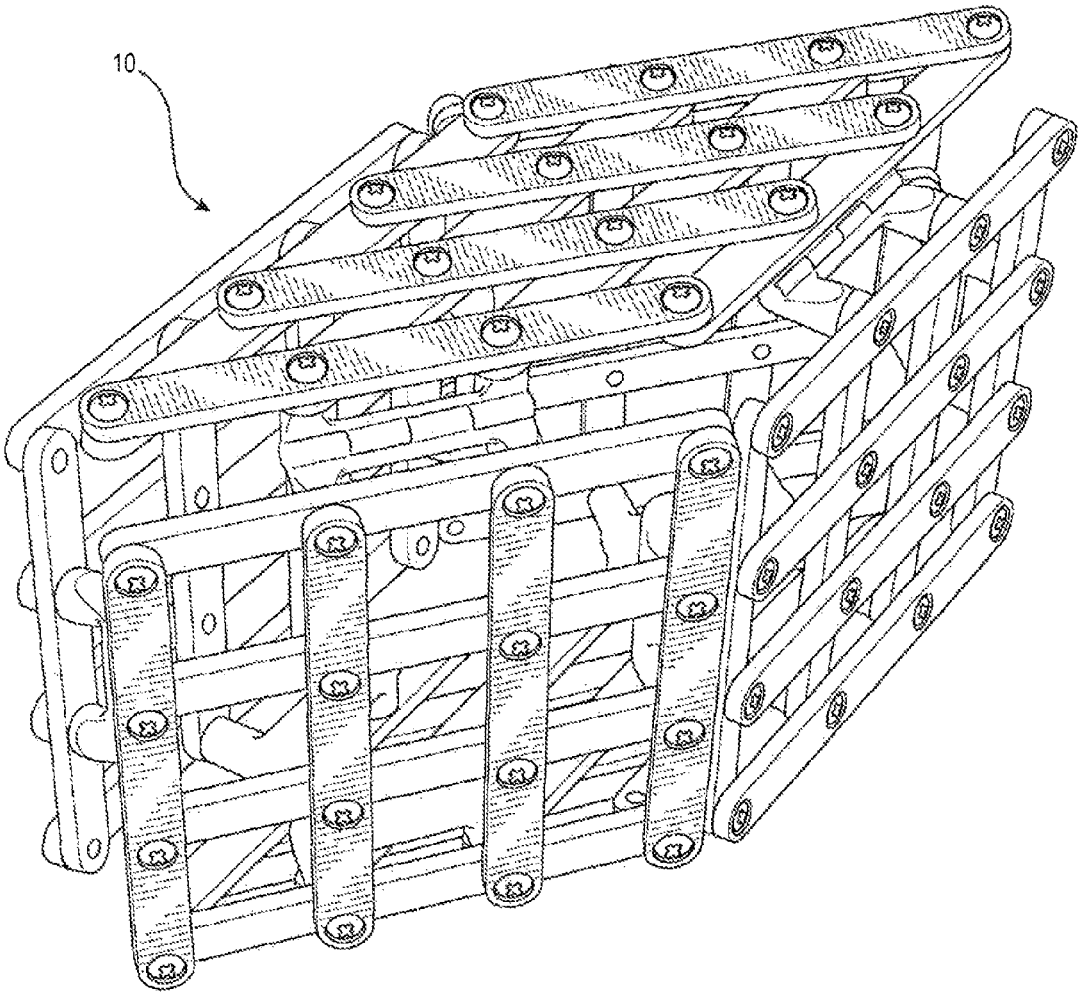

The eight bars 102, 104, 106, 108, 110, 112, 114, 116 are split into two groups of bars 118, 120 which are coupled in a manner permitting relative pivotal movement. In particular, the first set of (four) bars 118, are oriented to extend in a first longitudinal direction and remain substantially parallel regardless of the orientation of the present interactive educational toy 10. The second set of (four) bars 120 are oriented to extend in a second longitudinal direction and remain, substantially parallel regardless of the orientation of the present interactive educational toy 10 as will be described. The first set of bars 118 and the second set of bars 120 are coupled together such that the first set of bars 118 extend in a direction transverse to the second set of bars 120. However, and as will be appreciated based upon the following disclosure, the first set of bars 118 are pivotally mounted to the second set of bars 120 and therefore the relative position of the first set of bars 118 and the second set of bars 120 may change. However, when the interactive educational toy 10 is oriented as a cube as shown in FIG. 1, the longitudinal axes of four bars 102, 104, 106, 108 making up the first set of bars 118 and the longitudinal axes of the four bars 110, 112, 114, 116 making up the second set of bars 120 are oriented perpendicular to each other.

The first set of bars 118 and the second set of bars 120 are coupled to each other with snap connectors 122 extending between the respective bars 102, 104, 106, 108 of the first set of bars 118 and the respective bars 110, 112, 114, 116 of the second set of bars 120 at the intersecting points of the respective bars. Preferably the coupling points are equally spaced and result in a square face having nine equal sized openings when the interactive education toy 10 is in its cube configuration as shown in FIG. 1.

As will be appreciated based upon the following disclosure, each of the edges 124, 126, 128, 130 of the first face 100 is provided with a hinge-like coupling member 132, 134, 136, 138 shaped and dimensioned for pivotal coupling with a similar hinge-like coupling member of an adjacent face of the present interactive education toy 10. Each of the hinge-like coupling members 132, 134, 136, 138 are connected to the respective edges 124, 126, 128, 130 of the first face 100 in a manner permitting pivotal movement between the hinge-like coupling members 132, 134, 136, 138 and those bars oriented transverse to the edge. For example, bars 104 and 106 are connected to the hinge-like coupling member 132 in a manner permitting pivotal movement between the bars 104, 106 and the coupling member 132. The coupling members 132, 134, 136, 138 extend from the back surface of the first face 100 such that the coupling members 132, 134, 136, 138 are substantially within the interior of the interactive educational toy once fully formed. As such, the first face 100 includes first, second, third and fourth hinge-like coupling members 132, 134, 136, 138 which pivot about an axis perpendicular to the plane in which the first face 100 lies allowing for multi-planar movement in a manner explained herein. It is appreciated specific dimensional constraints are not required for implementation of the present interactive educational toy 10. While the mathematical relationships (ratios) between various parts determine the character and parameters of how the interactive educational toy 10 moves, it is appreciated these relationships may be varied. For example, if certain dimensions were a little longer or shorter, the interactive educational toy 10 might not flex quite as much, or might flex further. As another example, if every dimension in the toy were scaled up by 200%, the toy would work exactly the same.

Each of the hinge-like coupling members 132, 134, 136, 138 includes two male members 150, 152 and two female members 154, 156, shaped and dimensioned for engagement with similarly shaped male and female members of adjacent faces. The connection of adjacent hinge-like coupling members 132, 134, 136, 138 creates a hinge between adjacent faces allowing the faces to rotate relative to each other about an axis parallel to the connected edges of the adjacent faces. In accordance with a preferred embodiment, the two male members 150, 152 and two female members 154, 156 are spaced along the coupling members 132, 134, 136, 138 in a male member 150, female member 154, male member 152, female member 156 arrangement, and will snap fit with the similar coupling members of the adjacent face. As such, care should be taken to ensure male and female members of adjacent faces are aligned properly to ensure proper assembly of the present interactive educational toy 10. In practice, the arrangement of the male members 150, 152 and the female members 154, 156 is reversed on the top and bottom (first and third) edges 124, 128 of the face 100 and the arrangement of the male members 150, 152 and the female members 154, 156 is reversed on the left and right side (second and fourth) edges 126, 130 of the face 100. As those skilled in the art will appreciate, the present interactive educational toy may be reoriented changing the relative edges, and the designation of top/bottom/left/right edges is merely arbitrary and for the purpose of the describing the present invention.

As briefly discussed above, the present interactive education toy 10 includes six faces 100, 200, 300, 400, 500, 600. Each of the second, third, fourth, fifth and sixth faces 200, 300, 400, 500, 600 are identical to the first face 100. As such, and for the sake of brevity we will not repeat the foregoing description, only explain that the various faces are all identical with hinge-like coupling members oriented to permit attachment of adjacent faces.

With the first, second, third, fourth, fifth and sixth faces 100, 200, 300, 400, 500, 600 coupled together with the hinge-like coupling members, a parallelogram structure is provided. The structure does not remain a static cube, because the faces may move relative to each other such that the interactive education toy may assume a variety of shapes depending upon the relative orientation of the various faces. In particular, and in consideration of the pivoting relationship between the faces as provided by engagement of adjacent hinge-like coupling members, as well as the pivoting allowed between the coupling members and the faces to which, they are secured, a variety of orientations are possible.

In accordance with a preferred embodiment, the first face 100 is coupled to the third face 300, the fourth face 400, the fifth face 500 and the sixth face 600 respectively along the first edge 124, second edge 126, third edge 128 and the fourth edge 130 of the first face 100. As such, the first hinge-like coupling member 132 of the first face 100 is coupled to the second hinge-like coupling member 334 of the third face 300 to define a first hinge 12, the second hinge-like coupling member 134 of the first face 100 is coupled to the third hinge-like coupling member 436 of the fourth face 400 to define a second hinge 14, the third hinge-like coupling member 136 of the first face 100 is coupled to the fourth hinge-like coupling member 538 of the fifth face 500 to define a third hinge 16, and the fourth hinge-like coupling member 138 of the first face 100 is coupled to the first hinge-like coupling member 632 of the sixth face 600 to define a fourth hinge 18. The other faces are similarly coupled to adjacent faces in a manner defining the present interactive education toy.

As explained above, and with reference to FIGS. 5 to 9, movement of the interactive educational 10 results in various shapes. With the edges hinged together and the lattice structure of the respective faces permitting pivotal movement of the bars relative to each other, the present interactive education device may assume the shape of various proportioned parallelepipeds.

While the preferred embodiments have been shown and described, it will be understood that there is no intent to limit the invention by such disclosure, but rather, is intended to cover all modifications and alternate constructions falling within spirit and scope of the invention.

What is claimed is:

1. An interactive educational toy, comprising:

six faces joined in a manner permitting multi-planar movement;

each of the six faces is comprised of plurality of bars pivotally connected in a pantographic configuration;

each of the six faces includes sides, and the sides of adjacent faces are hinged together to form a cube that can shift into variously proportioned parallelepipeds, a plurality of hinge-like coupling members connecting the sides of adjacent faces in a manner permitting multi-planar movement of the six faces relative to each other, wherein the plurality of hinge-like coupling members allow adjacent faces to rotate relative to each other about a first axis parallel to a connected edge of the adjacent faces and allow pivotal movement of the connected edges relative to the plurality of hinge-like coupling members to which they are connected along a second axis perpendicular to the first axis.

2. An interactive educational toy, comprising:

six faces joined in a manner permitting multi-planar movement;

each of the six faces is comprised of plurality of bars pivotally connected in a pantographic configuration;

each of the six faces includes sides, and the sides of adjacent faces are hinged together to form a cube that can shift into variously proportioned parallelepipeds;

wherein each of the six faces includes eight bars connected together in a manner defining a lattice structure and the eight bars are of the same size and shape.

3. The interactive educational toy according to claim 1, wherein each of the six faces includes a first set of bars and a second set of bars, the first set of bars being oriented to extend in a first longitudinal direction and remain substantially parallel regardless of orientation of the interactive educational toy.

4. The interactive educational toy according to claim 3, wherein the second set of bars are oriented to extend in a second longitudinal direction and remain substantially parallel regardless of the orientation of the interactive educational toy.

5. An interactive educational toy, comprising:

six faces joined in a manner permitting multi-planar movement;

each of the six faces is comprised of plurality of bars pivotally connected in a pantographic configuration;

each of the six faces includes sides, and the sides of adjacent faces are hinged together to form a cube that can shift into variously proportioned parallelepipeds;

wherein each of the six faces includes a first set of bars and a second set of bars, the first set of bars being oriented to extend in a first longitudinal direction and remain substantially parallel regardless of orientation of the interactive educational toy, wherein the second set of bars are oriented to extend in a second longitudinal direction and remain substantially parallel regardless of the orientation of the interactive educational toy, and wherein the first set of bars includes four bars and the second set of bars includes four bars.

6. The interactive educational toy according to claim 3, wherein the first set of bars and the second set of bars are coupled together such that the first set of bars extend in a direction transverse to the second set of bars and the first set of bars are pivotally mounted to the second set of bars and therefore a relative position of the first set of bars and the second set of bars may change.

7. The interactive educational toy according to claim 3, wherein when the interactive educational toy is oriented as a cube, longitudinal axes of the first set of four bars and longitudinal axes of the second set of four bars are oriented perpendicular to each other.

8. The interactive educational toy according to claim 3, wherein the first set of bars and the second set of bars are coupled to each other with snap connectors extending between respective bars of the first set of bars and respective bars of the second set of bars at intersecting points of the respective bars.

9. The interactive educational toy according to claim 8, wherein the intersecting points are equally spaced and result in a square face when the interactive education toy is in a cube configuration.

10. The interactive educational toy according to claim 1, wherein each of the plurality of hinge-like coupling members extends from a back surface of each of the six faces such that each of the plurality of hinge-like coupling member is substantially contained within an interior of the interactive educational toy once fully formed.

11. The interactive educational toy according to claim 10, wherein each of the plurality of hinge-like coupling members includes two male member and two female members shaped and dimensioned for engagement with similarly shaped male and female members of adjacent faces.

12. The interactive educational toy according to claim 11, wherein the two male members and two female members are spaced along the hinge-like coupling members and snap fit with the hinge-like coupling members of the adjacent face.

* * * * *